US006217462B1

(12) United States Patent
Maruko et al.

(10) Patent No.: US 6,217,462 B1
(45) **Date of Patent: *Apr. 17, 2001**

(54) GOLF BALL

(75) Inventors: Takashi Maruko; Hisashi Yamagishi; Atsushi Nakamura; Yutaka Masutani, all of Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/428,789

(22) Filed: Oct. 28, 1999

(30) Foreign Application Priority Data

Feb. 26, 1999 (JP) ..... 11-049869

(51) Int. Cl.[7] ..... A63B 37/06
(52) U.S. Cl. ..... 473/370
(58) Field of Search ..... 473/373, 376, 473/377, 378, 354, 370, 361

(56) References Cited

U.S. PATENT DOCUMENTS 698,516 * 4/1902 Kempshall ..... 473/376
790,955 * 5/1905 Davis ..... 473/376
2,376,085 5/1945 Radford et al. .
5,439,227 8/1995 Egashira et al. .
5,490,674 2/1996 Hamada et al. .
5,692,973 12/1997 Dalton .
5,820,485 * 10/1998 Hwang ..... 473/378
5,984,807 * 11/1999 Wai et al. ..... 473/376

FOREIGN PATENT DOCUMENTS 285565 11/1997 (JP) .

* cited by examiner

*Primary Examiner*—Sebastiano Passaniti
*Assistant Examiner*—Raeann Gorden
(74) *Attorney, Agent, or Firm*—Sughrue, Mion, Zinn, Macpeak & Seas, PLLC

(57) ABSTRACT

A golf ball includes a core, two or more intermediate layers, and a cover. In the golf ball, convex ribs are formed on the outer surface of the innermost intermediate layer (surrounding layer) covering the core such that the ribs intrude into an intermediate layer adjacent to the surrounding layer. Further, the hardness of the surrounding layer is made greater than those of the core and the intermediate layer adjacent to the surrounding layer.

15 Claims, 5 Drawing Sheets

OCTAHEDRON

OCTAHEDRON

ICOSAHEDRON

GOLF BALL

BACKGROUND OF THE INVENTION

1. Field of the Invention

The present invention relates to a multi-layer solid golf ball comprising a core, two or more intermediate layers, and a cover. More particurly, it relates to a golf ball in which convex ribs are formed on the outer surface of the innermost intermediate layer (surrounding layer) covering the core such that the ribs intrude into an adjacent intermediate layer.

2. Related Art

Various techniques have been studied and proposed for increasing travel distance of a golf ball and providing a player with an excellent feel upon hitting the golf ball (hereinafter may be called "hit feel"). Especially in a golf ball having a solid core and a cover, the hardness and size (diameter and thickness) of the core and the hardness and size of the cover are adjusted for such purposes.

For example, U.S. Pat. No. 5,439,227 discloses a three-piece golf ball which has a solid core, an inner cover, and an outer cover and in which the outer cover is made harder than the inner cover. Also, U.S. Pat. No. 5,490,674 discloses a three-piece golf ball which has inner and outer solid cores covered with a cover and in which the inner solid core is made harder than the outer solid core.

In the above-described golf balls, the boundary surface of each layer is generally a smooth spherical surface having neither projections nor depressions. However, U.S. Pat. Nos. 2,376,085 and 5,692,973 disclose a golf ball which has on its solid core projections for preventing eccentricity of the solid core, which eccentricity could otherwise arise when a cover is formed around the core through injection molding.

The projections on the solid core of the above-described golf ball are designed to substitute support pins used in an injection molding process, and the effect obtained by the shape of the support-pin-shaped projections is not utilized to improve the performance of the golf ball. In other words, the inventions of U.S. Pat. Nos. 2,376,085 and 5,692,973 relate to a technique for preventing eccentricity of the solid core and preventing mixture of a different material into the cover. According to the technique, by employment of the same material as used for the cover, projections are formed on the core surface such that the cover has a uniform thickness, and the projections and the cover are thus united. As described above, the projections are not designed to improve the performance of the golf ball.

Also, Japanese Patent Application Laid-Open (kokai) No. 9-285565 discloses a two-piece golf ball which has projections and depressions between a solid core and a cover, between two adjacent layers of a multi-layer solid core, or between two adjacent layers of a multi-layer cover. The two-piece golf ball provides a player with different hit feels, depending on the direction of an external force acting on the golf ball during hitting.

The two-piece golf ball has improved in terms of hit feel provided to a player. However, the travel performance and durability are not satisfactory, and there is room for further improvement.

SUMMARY OF THE INVENTION

In view of the foregoing, an object of the present invention is to provide a golf ball which comprises a core, two or more intermediate layers, and a cover, in which convex ribs are formed on the outer surface of the innermost intermediate layer (surrounding layer) covering the core such that the ribs intrude into an adjacent intermediate layer, which has an improved travel performance and controllability, as compared with a conventional golf ball, and which provides a player with an improved hit feel as compared with a conventional golf ball.

In order to achieve the above object, the present inventors have conducted earnest studies, taking notice that when the effect of the configuration at a boundary between the layers of a golf ball; i.e. the cross-sectional, two-dimensional moment of a member that constitutes each of the convex ribs is increased, the bending strength of the member can be increased with no corresponding increase in hardness.

As a result, the present inventors found the following. In a golf ball comprising a core, two ore more intermediate layers, and a cover, when convex ribs are formed on the outer surface of the innermost intermediate layer (surrounding layer) such that the ribs intrude into an adjacent intermediate layer, and the hardness of the surrounding layer is made greater than those of the core and the adjacent intermediate layer, the bending strength of the member—which constitutes the convex ribs—increases because of the effect of the rib shape. As a result, when the golf ball is hit at a relatively high head speed by use of a driver or a like club, the degree of backspin of the golf ball decreases and the travel distance increases accordingly. When the golf ball is hit at a relatively low head speed by use of a short iron or a like club, the hardness of the member does not exceed a level of hardness in conventional golf balls, yielding excellent controllability and providing soft feel.

The present invention was accomplished on the basis of the above-described findings, and provides a golf ball which comprises a core, two or more intermediate layers, and a cover, and in which convex ribs are formed on the outer surface of the innermost intermediate layer (surrounding layer) covering the core such that the ribs intrude into an intermediate layer adjacent to the surrounding layer, and the hardness of the surrounding layer is made greater than those of the core and the intermediate layer adjacent to the surrounding layer.

The golf ball according to the present invention has the following advantageous features:

(i) When the golf ball is hit at a relatively high head speed by use of a driver or a like club, the degree of backspin of the golf ball decreases, and the travel distance increases accordingly.

(ii) When the golf ball is hit at a relatively low head speed by use of a short iron or a like club, the degree of backspin increases, so that excellent controllably is maintained.

(iii) A player is provided with a soft feel when hitting the golf ball with a driver, and is provided with a firm and solid feel when hitting the golf ball with a short iron.

DESCRIPTION OF THE PREFERRED EMBODIMENT

Figure 1:
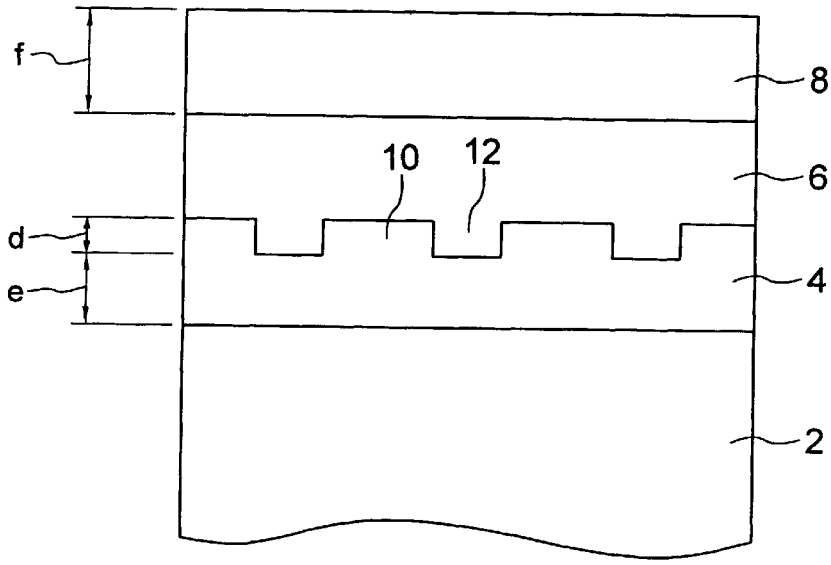
FIG. 1 is sectional view schematically showing an exemplary golf ball according to the present invention.

The present invention will now be described in more detail with reference to the drawings. FIG. 1 is a cross-sectional view which schematically shows an example of a golf ball according to the present invention. The golf ball according to the present invention composes a solid core 2, a first intermediate layer (surrounding layer) 4 covering the solid core 2, a second intermediate layer 6 covering the surrounding layer 4, and a cover 8 covering the second intermediate layer 6. Also, the hardness of the surrounding layer 4 is made greater than those of the core 2 and the adjacent intermediate layer 6. Although the golf ball of the present embodiment has two intermediate layers, the golf ball may have three or more intermediate layers. Further, if necessary each of the core 2 and the cover 8 may be formed to have a plurality of layers.

In the present invention, when a load of 100 kg is applied to the core 2, the core preferably deforms in an amount of 3.5–10.0 mm, more preferably 3.5–7.0 mm. When the core deforms in an amount of less than 3.5 mm, the core is excessively hard, so that a good hit feel may not be obtained, whereas when the core deforms in an amount of more than 10.0 mm, the core is too soft to obtain a sufficient degree of the resilience.

The surrounding layer 4 preferably has a hardness of 56 or more, more preferably 58–68, in Shore D hardness. The difference in hardness between the surrounding layer and the adjacent intermediate layer 6 is preferably 5 or more, more preferably 10 or more in Shore D hardness. When the hardness of the surrounding layer is less than 56 in Shore D hardness, the surrounding layer is too soft to yield the effect of the ribs to a sufficient level. When the hardness of the surrounding layer is greater than 68, the surrounding layer is excessively hard, so that the hit feel may deteriorate. Also, when the difference in hardness is less than 5, the difference is too small to yield the effect of the rib to a sufficient level.

Figure 2:
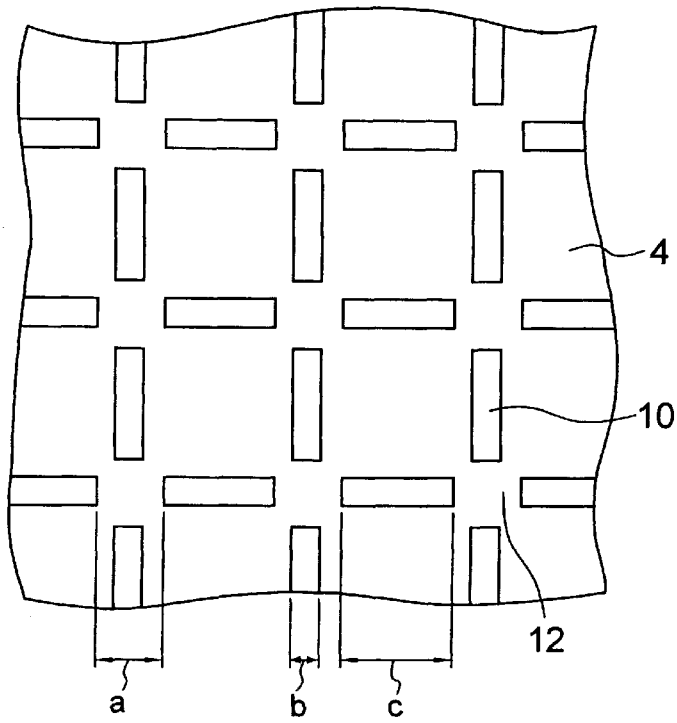
FIG. 2 is a plan view schematically showing the outer surface of a surrounding layer on which convex ribs are formed.

In the golf ball according to the present invention, the convex ribs 10 are formed on the outer surface of the surrounding layer 4 such that the ribs intrude into the adjacent intermediate layer 6. If necessary, the golf ball according to the present invention may be configured such that the ribs are arranged in a network pattern, and a plurality of cutaway portions 12 are provided between the ribs 10, as shown in FIG. 2. When the cutaway portions 12 are formed, the travel distance is increased, the controllability is improved, and the hit feel is improved. Also, the cutaway portions serve as passages through which resin flows during the injection molding process in which the surrounding layer is injection-molded around the core, or the adjacent intermediate layer is injection-molded around the surrounding layer. As a result, the surrounding layer and the adjacent intermediate layer are molded properly, imparting improved symmetry to the golf ball. In order to enable the cutaway portions 12 to function effectively as the flow passages, the cutaway portions are preferably formed such that the ribs 10 do not intersect each other and do not form any closed circle, as shown in FIG. 2.

The width a (the distance between two adjacent ribs 10, see FIG. 2) of the cutaway portions 12 is preferably 0.5–10.0 mm, more preferably 2.0–8.0 mm. When the width a of the cutaway portions is smaller than 0.5 mm, resin may not flow smoothly through the cutaway portions during injection molding, whereas when the width of the cutaway portions is greater than 10.0 mm, the symmetry of the golf ball may deteriorate.

The width b of the ribs 10 is preferably 0.3–2.5 mm, more preferably 0.5–2.0 mm. When the width b of the ribs 10 is less than 0.3 mm, the ribs become excessively thin, so that the effect of the ribs may becomes insufficient. When the width of the ribs is greater than 2.5 mm, the ribs become excessively thick, so that the hit feel and the symmetry of the golf ball may deteriorate. The length c of the ribs 10 separated by means of the cutaway portions 12 is preferably 3.0–15.0 mm, more preferably 4.0–10.0 mm.

Figure 3A:
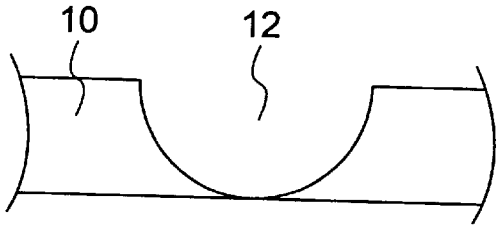
FIGS. 3A, 3B, and 3C are side views each showing the shape of a cutaway portion.
Figure 3B:
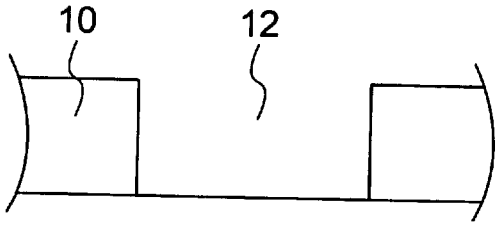
Figure 3C:
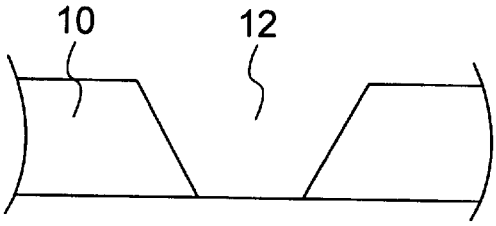

The cutaway portions 12 can be formed in an arbitrary shape through the selection of tools used for fabrication of a mold. For example, each of the cutaway portions 12 may have a semicircular cross section (FIG. 3(*a*)), a rectangular cross section (FIG. 3(*b*)), or a trapezoidal cross section (FIG. 3(*c*)), when the rib 10 is viewed from a transverse direction.

The height d of the ribs 10 is preferably 0.3–2.5 times, more preferably 0.5–2.0 times the thickness e of the surrounding layer 4, the thickness excluding the height of ribs (see FIG. 1). When the ratio is less than 0.3 times, the thickness of the ribs becomes excessively small, so that the effect of the ribs cannot be obtained sufficiently. When the ratio is more than 2.5 times, the thickness of the intermediate layer which receives the ribs becomes excessively large, so that the resilience of the golf ball may decrease.

The golf ball has a stronger rib structure, if the golf ball is fabricated by a method in which the surrounding layer 4 and the cover 8 are made of the same main material; the ribs 10 are formed to penetrate the adjacent intermediate layer 6; and the cover 8 is molded such that the end portions of the ribs 10 and the cover 8 are welded for integration.

The thickness e of the surrounding layer 4 (the thickness of the surrounding layer as measured at a portion where the ribs are not present) is preferably 0.3–3.0 mm, more preferably 0.5–2.5 mm. When the thickness e of the surrounding layer is less than 0.5 mm, the ribs may become difficult to mold. When the thickness of the surrounding layer is more than 3.0 mm, the surrounding layer is excessively thick, so that the hit feel may deteriorate.

The thickness f of the cover 8 is preferably 0.3–3.0 mm, more preferably 0.5–2.5 mm. The hardness of the cover 8 in Shore D hardness is preferably 5 or more, more preferably 10 or more greater than that of the adjacent intermediate layer 6. When the thickness f of the cover is less than 0.3 mm, durability problems, such as formation of a crack in the cover, may arise. If the thickness of the cover is greater than 3.0 mm, the cover is excessively thick, so that the hit feel may deteriorate. The hardness of the cover is preferably 40–70, more preferably 50–65, in Shore D hardness. The cover may be formed of a single layer made of a single material or formed of two or more laminated layers made of different materials. When the cover takes a multi-layer structure, the total thickness of the cover and the hardness of each layer may be adjusted to fall within the above-described range.

Although the arrangement of the ribs 10 is not limited to the network pattern, the ribs are particularly preferably formed in arrangement 1 or 2 described below. When one of these arrangements is adopted, a high degree of symmetry is realized, and molding is simplified.

Figure 4:
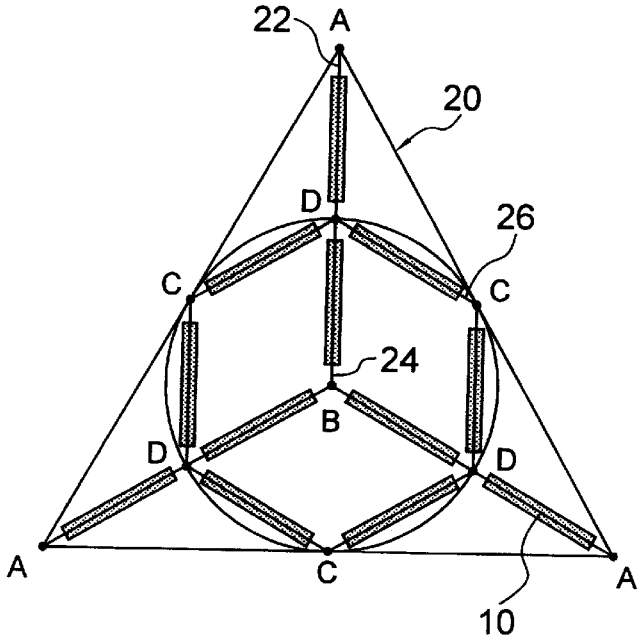
FIG. 4 is an explanatory view showing an example in which ribs are arranged in a network pattern.
Figure 5:
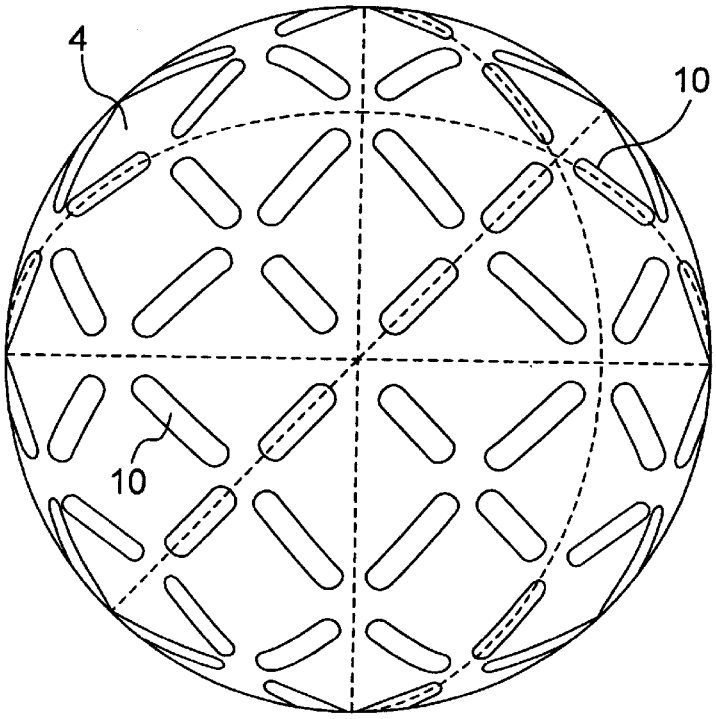
FIG. 5 is a plan view showing an example in which ribs are formed on the outer surface of a surrounding layer.

Arrangement 1: As shown in FIG. 4, each of the apexes of each spherical triangle 20 of a regular octahedron assumed on the outer surface of the surrounding layer is represented by A, the center (inner center; the center of an inscribed circle) of the triangle is represented by B, the midpoint of each side of the triangle is represented by C, and the midpoint of a line connecting the center B and each apex A is represented by D, the rib 10 is formed along each of a line 22 between point A and point D, a line 24 between point B and point D, and a line 26 between point C and point D. FIG. 5 shows a specific example of Arrangement 1, in which the ribs 10 are formed on the outer surface of the surrounding layer 4 in accordance with Arrangement 1.

Figure 6:
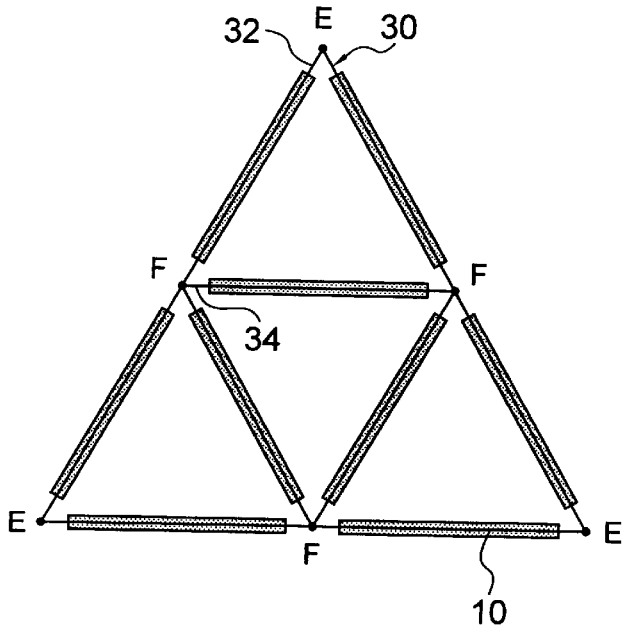
FIG. 6 is an explanatory view showing an example in which ribs are arranged in a network pattern.
Figure 7:
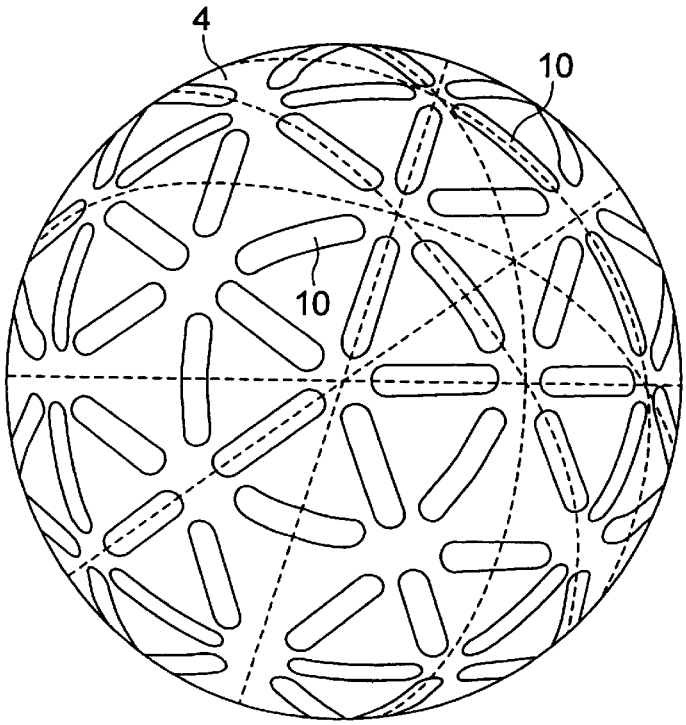
FIG. 7 is a plan view showing an example in which the ribs are formed on the outer surface of a surrounding layer.

Arrangement 2: As shown in FIG. 6, each of the apexes of each spherical triangle 30 of a regular icosahedron assumed on the outer surface of the surrounding layer is represented by E and the midpoint of each side of the triangle is represented by F, the rib 10 is formed along each of a line 32 between point E and point F and a line 34 between point F and another point F. FIG. 7 shows a specific example of Arrangement 2, in which the ribs 10 are formed on the outer surface of the surrounding layer 4 in accordance with Arrangement 2.

Figure 8:
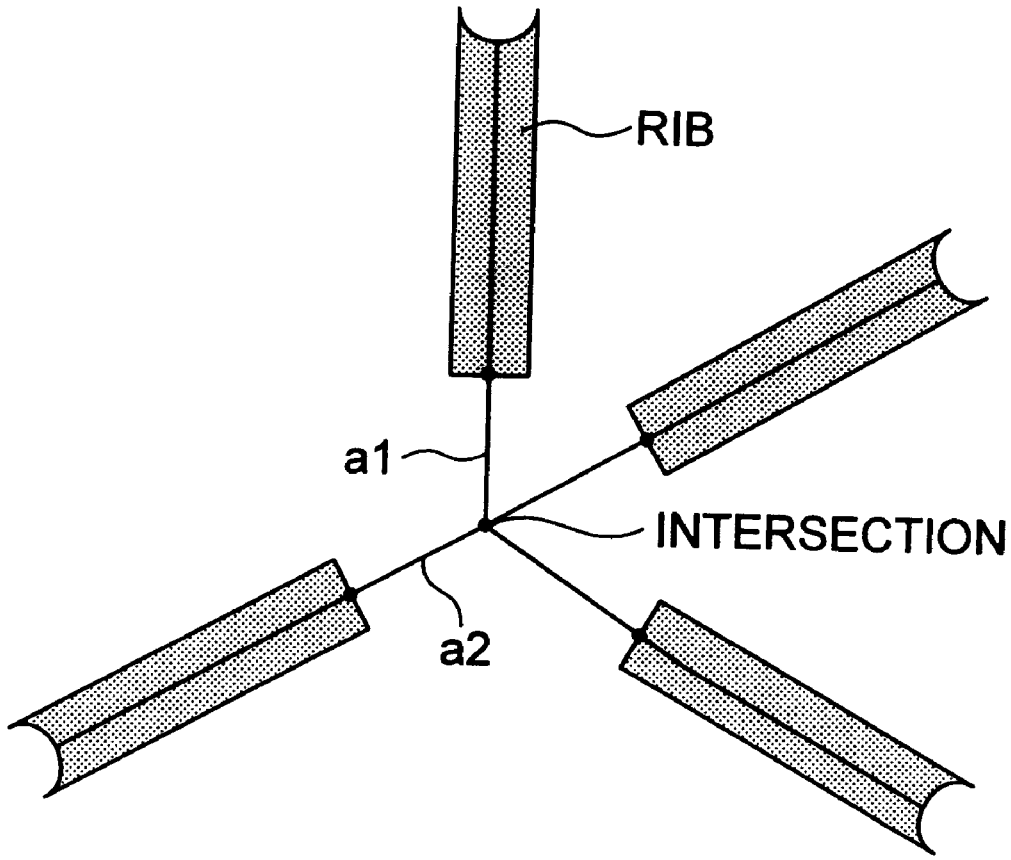
FIG. 8 is an explanatory view showing a method of determining the width of a cutaway portion when the axes of adjacent ribs do not form a straight line.

When the axes of adjacent ribs do not form a straight line as shown in FIGS. 4 and 6, the width a of the cutaway portions 12 (the distance between adjacent ribs 10) is a distance as measured through the intersection between the axes of the adjacent ribs 10, as shown in FIG. 8. That is, the width a of the cutaway portions 12 is the sum of distances a1 and a2.

Next, the composition of each layer of the golf ball according to the present invention will be described. In the golf ball, the solid core is formed of a base rubber material such as 1,4-cis-polybutadiene, polyisoprene, natural rubber, or silicone rubber, among which 1,4-cis-polybutadiene is particularly preferred, because 1,4-cis-polybutadiene can improve resilience.

A zinc or magnesium salt of an unsaturated fatty acid such as zinc methacrylate and zinc acrylate, or an ester compound such as trimethylpropane methacrylate may be added, as a cross-linking agent, to the base rubber material, and among them, zinc acrylate is particularly preferred, because zinc acrylate can increase resilience. These linking agents are preferably incorporated in an amount of 15–40 parts by weight based on 100 parts by weight of the above-described base rubber material. Also, a vulcanizing agent may be added in an amount of 0.1–5 parts by weight based on 100 parts by weight of the base rubber material.

If necessary, zinc oxide and/or barium sulfate may be added to the base rubber material, as an antioxidant or a filler for adjusting specific gravity. The amount of the filler is 5–130 parts by weight based on 100 parts by weight of the base rubber material.

The base rubber material (a rubber composition for the solid core) preferably has the following composition:

| | |
|---|---|
| 1,4-cis-polybutadiene | 100 parts by weight |
| zinc oxide | 5–40 parts by weight |
| zinc acrylate | 15–40 parts by weight |
| barium sulfate | 0–40 parts by weight |
| peroxide | 0.1–5.0 parts by weight |

Desirable vulcanization conditions; temperature: 150±10° C., vulcanization time: 5–20 minutes.

The above-described rubber composition for the solid core is kneaded by use of a conventional mixer (for example, a Banbury mixer, a kneader, or a roll). The thus-obtained compound is molded through injection molding or compression molding employing a mold for the core.

In the thus-obtained solid core, the diameter is preferably 25.0–36.0 mm, more preferably 29.0–35.0 mm; the Shore D hardness is preferably 20–50, more preferably 25–45; and the weight is typically about 12–35.0 g.

No limitation is imposed on the material of the surrounding layer (the intermediate layer covering the core), and a rubber material can be used; however, the surrounding layer is preferably formed from a resin material such as an ionomer resin; an amide resin such as nylon; a urethane resin; or a polyester elastomer such as Hytrel. The ratio of the thickness (mm) of the surrounding layer (the thickness of the surrounding layer as measured at a portion where the ribs are not present) to the diameter (mm) of the core preferably falls within the range of 1:9–1:72, more preferably 1:11–1:36.

In the present invention, the ribs are formed such that they extend outwardly from the outer surface of the surrounding layer. In other words, portions of the surrounding layer intrude into the adjacent intermediate layer. In this case, the ribs are preferably formed on the surface of the surrounding layer during molding of the surrounding layer. Specifically, a mold for molding the surrounding layer is fabricated such that depressions corresponding to the ribs are formed on the inner wall of the cavity of the mold, and the ribs are integrally molded with the surrounding layer in an ordinary manner by use of the mold. In some cases, the ribs may be formed separately from the surrounding layer and then bonded onto the surface of the surrounding layer.

Subsequently, the surrounding layer having the ribs on its surface is covered with a material for the adjacent intermediate layer through injection molding or compression molding (preferably injection molding), so that the ribs are formed in the adjacent intermediate layer.

No limitation is imposed on the material of the above-described adjacent intermediate layer (when a plurality of intermediate layers are formed around the surrounding layer, the term "intermediate layer" means each of the plurality of intermediate layers). Either resin or rubber may be used, but, in view of durability, a resin having a high impact resistance is preferably used. For example, polyester resin such as polyester elastomer, polyurethane resin, ionomer resin, styrene elastomer, hydrogenated butadiene resin, or a mixture of these materials can be used for the adjacent intermediate layer. Among them, polyester resin such as polyester elastomer and polyurethane resin are particularly preferred. Specifically, commercially available products such as Hytrel 3078, 4047, and 4767 (products of Toray DuPont) may be used. In this case, the Shore D hardness of the adjacent intermediate layer is preferably set to 10–50, more preferably 15–45.

Subsequently, the adjacent intermediate layer is covered with a material for the cover through ordinary injection or compression molding. No particular limitation is imposed on the cover material, and a known cover material can be used. Examples of the cover material include ionomer resin, polyurethane resin, polyester resin, and balata rubber. However, ionomer resin is preferred; more specifically, commercially available products such as Surlyn (product of DuPont) and Himilan (product of DuPont Mitsui Polychemicals) may be used.

If necessary, titanium dioxide, barium sulfate, or any other suitable material may be added to the cover material for the purpose of, for example, adjustment of the specific gravity. Furthermore, if necessary, an UV absorber, an antioxidant, and a dispersant such as metallic soap may be added to the cover material.

In the thus-obtained golf ball, many dimples are formed on its surface. If necessary, coating, stamping, and other finishing treatments are performed on the surface of the golf ball. The golf ball has a hardness such that when a load of 100 kg is applied to the golf ball, the ball deforms in an amount of 2.6–4.0 mm, more preferably 2.8–3.8 mm. In compliance with the R&A golf rules, the golf ball is formed such that the golf ball has a diameter of 42.67 mm or greater and a weight of 45.93 g or less.

EXAMPLES

The present invention will be specifically described with reference to Examples and Comparative Examples. However, the present invention is not restricted to the Examples. All amounts shown in Table 1 represent parts by weight.

TABLE 1

| | | Examples | | | | Comparative Examples | | | |
|---|---|---|---|---|---|---|---|---|---|
| | | 1 | 2 | 3 | 4 | 1 | 2 | 3 | 4 |
| Composition of core | 1,4-cis-Polybutadiene | 100.0 | 100.0 | 100.0 | 100.0 | 100.0 | 100.0 | 100.0 | 100.0 |
| | Zinc acrylate | 17.0 | 23.0 | 13.0 | 9.0 | 17.0 | 17.0 | 13.0 | 26.0 |
| | Zinc oxide | 5.0 | 5.0 | 5.0 | 5.0 | 5.0 | 5.0 | 5.0 | 5.0 |
| | Antioxidant | 0.2 | 0.2 | 0.2 | 0.2 | 0.2 | 0.2 | 0.2 | 0.2 |
| | Barium sulfate | 37.0 | 29.3 | 45.7 | 50.7 | 40.6 | 37.0 | 54.9 | 20.8 |
| | Dicumyl peroxide | 0.9 | 0.9 | 0.9 | 0.9 | 0.9 | 0.9 | 0.9 | 0.9 |
| Composition of surrounding layer | Himilan 1557 | — | — | 20 | — | — | — | 20 | — |
| | Himilan 1605 | 50 | — | 50 | — | — | 50 | 50 | — |
| | Himilan 1706 | 50 | — | 30 | — | — | 50 | 30 | — |
| | Himilan 1855 | — | — | — | 50 | — | — | — | — |
| | Himilan 1856 | — | — | — | 50 | — | — | — | — |
| | Himilan AM 7317 | — | 50 | — | — | — | — | — | — |
| | Himilan AM 7318 | — | 50 | — | — | — | — | — | — |
| | Hytrel 4047 | — | — | — | — | 100 | — | — | — |
| Composition of adjacent intermediate layer | Hytrel 3078 | — | 100 | — | — | — | — | — | — |
| | Hytrel 4047 | 100 | — | 100 | — | — | 100 | 100 | 100 |
| | PANDEX T-2983 | — | — | — | 100 | — | — | — | — |
| | Himilan 1605 | — | — | — | — | 50 | — | — | — |
| | Himilan 1706 | — | — | — | — | 50 | — | — | — |
| Composition of cover | Himilan 1557 | 20 | 20 | — | — | 20 | 20 | — | 20 |
| | Himilan 1605 | — | 50 | 50 | — | — | — | 50 | — |
| | Himilan 1706 | 30 | 30 | 50 | — | 30 | 30 | 50 | 30 |
| | Himilan 1855 | 50 | — | — | 50 | 50 | 50 | — | 50 |
| | Himilan 1856 | — | — | — | 50 | — | — | — | — |

Hytrel: product of Toray DuPont, polyester-based thermoplastic elastomer
Himilan: product of DuPont Mitsui Polychemicals, ionomer resin
PANDEX: product of Dainippon Ink and Chemicals, polyurethane elastomer

Examples and Comparative Examples:

Golf balls of Examples 1–4 and Comparative Examples 1–4 were manufactured as follows. First, a solid core for each golf ball was produced. That is, a rubber composition for the solid core having a corresponding composition shown in Table 1 was kneaded by use of a kneader, and vulcanaized for about 15 minutes at 155 C° within a mold for the core.

Subsequently, a composition for a surrounding layer having a corresponding composition shown in Table 1 was kneaded and injection-molded around the solid core to thereby form the surrounding layer. Subsequently, a composition for an adjacent intermediate layer having a corresponding composition shown in Table 1 was kneaded and injection molded around the surrounding layer to thereby form the adjacent intermediate layer. Subsequently, a cover material having a corresponding composition shown in Table 1 was injection-molded around the thus-obtained adjacent intermediate layer to thereby form the cover. Subsequently, ordinary coating was applied to the cover. In this way, the golf balls of Example 1–4 and Comparative Examples 1–3 were completed. In the case of the golf ball of Example 4, the composition for the adjacent intermediate layer was injection molded directly around the core without formation of the surrounding layer to complete the golf ball.

The mold used for molding of the surrounding layer in Examples 1–4 and Comparative Examples 1 and 3 had depressions which were formed on the inner wall of the cavity, and thus convex ribs were formed on the outer surface of the surrounding layer during molding of the surrounding layer. The convex ribs intruded into the adjacent intermediate layer, and thus the convex ribs were formed in the adjacent intermediate layer. The thus-formed convex ribs were arranged in a network pattern of the above-described Arrangement 1 (regular octahedron arrangement).

Comparative Example 1 represents a golf ball in which the hardness of the surrounding layer is lower than that of the adjacent intermediate layer; Comparative Example 2 represents a four-layer golf ball having no ribs; Comparative Example 3 represents a golf ball in which the surrounding layer has a large thickness (measured at a portion where the ribs are not present); Comparative Example 4 represents a three-layer golf ball having no ribs.

Subsequently, the thus-obtained golf balls were evaluated in terms of travel performance and hit feel, in accordance with the method described below. The results are shown in Table 2.

Travel performance test:

Each golf ball was hit by a swing robot at the below-described speed, and initial speed, travel distance, and spin were measured.

(1) Driver (W#1), head speed: 45 m/s (HS45), loft: 11°

(2) Driver (W#1), head speed: 35 m/s (HS35), loft: 14°

The driver used in the test was a Tour Stage X100 (product of Bridgestone Sport).

Hit-feel test:

The golf balls were subjected to sensory evaluation test for hit feel in which three professional golfers hit the golf balls with a driver and evaluated hit feel. Evaluation criteria for hit feel are as follows: ◎: Outstanding ○: Excellent Δ: Good X: Poor

TABLE 2

| Ball configuration | | Examples | | | | Comparative Examples | | | |
|---|---|---|---|---|---|---|---|---|---|
| | | 1 four layers | 2 four layers | 3 four layers | 4 four layers | 1 four layers | 2 four layers | 3 four layers | 4 three layers |
| Core | Diameter (mm) | 32.7 | 34.5 | 29.9 | 26.2 | 32.7 | 32.7 | 29.9 | 35.7 |
| | Weight (g) | 22.7 | 26.0 | 17.9 | 12.2 | 23.1 | 22.7 | 18.6 | 27.9 |
| | Specific gravity (g/cc) | 1.240 | 1.120 | 1.280 | 1.300 | 1.260 | 1.240 | 1.330 | 1.170 |
| | Hardness (mm) *1 | 4.8 | 3.6 | 5.4 | 6.5 | 4.8 | 4.8 | 5.4 | 3.2 |
| Surrounding layer | Diameter (mm) | 35.7 | 36.5 | 32.6 | 29.8 | 35.7 | 35.7 | 36.5 | — |
| | Thickness (mm) | 1.50 | 1.00 | 1.35 | 1.80 | 1.50 | 1.50 | 3.30 | — |
| | Weight (g) *2 | 28.7 | 30.4 | 22.8 | 17.8 | 29.2 | 28.1 | 29.7 | — |
| | Specific gravity (g/cc) | 0.970 | 0.970 | 0.970 | 0.970 | 1.120 | 0.970 | 0.970 | — |
| | Shore D hardness | 65 | 68 | 60 | 56 | 40 | 65 | 60 | — |
| | Rib shape | | | | | | | | |
| | Width (mm) | 1.00 | 1.00 | 1.00 | 1.50 | 1.00 | — | 1.00 | — |
| | Height (mm) | 2.00 | 1.60 | 3.05 | 3.00 | 2.00 | — | 0.70 | — |
| | Height/thickness *3 | 1.33 | 1.60 | 2.26 | 1.67 | 1.33 | — | 0.21 | — |
| Adjacent intermediate layer | Diameter (mm) | 39.7 | 40.7 | 38.7 | 38.7 | 39.7 | 39.7 | 39.7 | 39.7 |
| | Thickness (mm) | 2.00 | 2.10 | 3.05 | 4.45 | 2.00 | 2.00 | 1.60 | 2.00 |
| | Weight (g) *4 | 38.0 | 40.4 | 35.5 | 35.4 | 37.9 | 38.1 | 37.9 | 37.9 |
| | Specific gravity (g/cc) | 1.120 | 1.080 | 1.120 | 1.160 | 0.970 | 1.120 | 1.120 | 1.120 |
| | Shore D hardness | 40 | 30 | 40 | 36 | 65 | 40 | 40 | 40 |
| Cover | Diameter (mm) | 42.7 | 42.7 | 42.7 | 42.7 | 42.7 | 42.7 | 42.7 | 42.7 |
| | Thickness (mm) | 1.50 | 1.00 | 2.00 | 2.00 | 1.50 | 1.50 | 1.50 | 1.50 |
| | Weight (g) *5 | 45.3 | 45.3 | 45.2 | 45.1 | 45.3 | 45.4 | 45.3 | 45.3 |
| | Specific gravity (g/cc) | 0.970 | 0.970 | 0.970 | 0.970 | 0.970 | 0.970 | 0.970 | 0.970 |
| | Shore D hardness | 58 | 60 | 65 | 56 | 58 | 58 | 65 | 58 |
| W#1 HS 45 m/s | Spin (rpm) | 2360 | 2280 | 2400 | 2470 | 1970 | 2650 | 2630 | 2560 |
| | Initial speed (m/s) | 63.7 | 63.7 | 63.6 | 63.5 | 63.2 | 63.4 | 63.2 | 63.4 |
| | Carry (m) | 208.1 | 207.6 | 207.3 | 208.6 | 201.4 | 206.2 | 202.7 | 205.6 |
| | Total distance (m) | 227.3 | 230.1 | 228.3 | 226.5 | 222.6 | 224.1 | 222.2 | 223.8 |
| | Hit feel | ◎ | ◎ | ◎ | ◎ | X | Δ | X | Δ |
| W#1 HS 35 m/s | Spin (rpm) | 3530 | 3400 | 3490 | 3550 | 3110 | 3740 | 3650 | 3670 |
| | Initial speed (m/s) | 50.6 | 50.6 | 50.5 | 50.4 | 50.1 | 50.3 | 50.1 | 50.3 |
| | Carry (m) | 145.6 | 146.2 | 144.9 | 143.9 | 140.6 | 143.7 | 139.9 | 143.5 |
| | Total distance (m) | 158.9 | 159.3 | 158.6 | 157.3 | 153.7 | 156.5 | 154.1 | 156.1 |
| | Hit feel | ◎ | ◎ | ◎ | ◎ | X | Δ | X | Δ |

*1 Deformation upon application of a load of 100 kg
*2 Core + surrounding layer
*3 Height of a rib/thickness of a surrounding layer, excluding the height of the rib
*4 Core + adjacent intermediate layer
*5 Core + adjacent intermediate layer + cover

What is claimed is:

1. A golf ball comprising; a core, two or more intermediate layers, and a cover, wherein convex ribs having a length greater than a width thereof are formed on an outer surface of the surrounding layer covering the core such that the ribs intrude into an outer intermediate layer adjacent to the surrounding layer, and the hardness of the surrounding layer is made greater than those of the core and the intermediate layer adjacent to the surrounding layer.

2. The golf ball according to claim 1, wherein an amount of deformation of the core upon application of a load of 100 kg thereto is 3.5 to 10.0 mm; the surrounding layer has a Shore D hardness of 56 or greater; and the difference in hardness between the surrounding layer and the intermediate layer adjacent to the surrounding layer is 5 or greater in Shore D hardness.

3. The golf ball according to claim 1, wherein the surrounding layer has a thickness of 0.3 to 3.0 mm, excluding the height of ribs.

4. The golf ball according to claim 1, wherein the ribs have a width of 0.3 to 2.5 mm and a length of 3.0 to 15.0 mm.

5. The golf ball according to claim 1, wherein the cover has a thickness of 0.3 to 3.0 mm and a Shore D hardness at least 5 greater than that of the intermediate layer adjacent to the surrounding layer.

6. The golf ball according to claim 1, wherein the convex ribs are formed in arrangement such that when a regular octahedron is assumed on the outer surface of the surrounding layer, and when in each spherical triangle of the regular octahedron, each apex is represented by A, the center is represented by B, the midpoint of each side is represented by C, and the midpoint of a line connecting the center B and each apex A is represented by D, the rib is formed along each of a line between point A and point D, a line between point B and point D, and a line between point C and point D.

7. The golf ball according to claim 1, wherein the convex ribs are formed in arrangement such that when a regular icosahedron is assumed on the outer surface of the surrounding layer, and when in each spherical triangle of the regular icosahedron, each apex is represented by E and the midpoint of each side is represented by F, the rib is formed along each of a line between point E and point F and a line between point F and another point F.

8. The golf ball according to claim 1, wherein the convex ribs are arranged in a network pattern.

9. The golf ball according to claim 8, wherein cutaway portions act as flow passages through which material flows during molding are formed between opposite ends of the convex ribs.

10. The golf ball according to claim 1, wherein the ribs have a height 0.3 to 2.5 times the thickness of the surrounding layer excluding the height of ribs.

11. The golf ball according to claim 1, wherein the core is formed of a base rubber material selected from 1,4-cis-polybutadiene, polyisoprene, natural rubber, or silicone rubber.

12. The golf ball according to claim 11, wherein the surrounding layer is formed of a resin material selected from ionomer resin, amide resin, urethane resin, or polyester elastomer.

13. The golf ball according to claim 1, wherein the intermediate layer adjacent to the surrounding layer is formed of a resin material selected from polyester resin, polyurethane resin, ionomer resin, styrene elastomer, hydrogenated butadiene resin, or a mixture of these materials.

14. The golfball according to claim 13, wherein the intermediate layer adjacent to the surrounding layer has a Shore D hardness of 10 to 50.

15. The golfball according to claim 1, wherein the cover is formed of a material selected from ionomer resin, polyurethane resin, polyester resin or balata rubber.

* * * * *